United States Patent [19]

Ross

[11] Patent Number: 4,998,628

[45] Date of Patent: Mar. 12, 1991

[54] GRAVITY-OPERATED BOTTLE AND CAN DISPENSING RACK

[75] Inventor: E. Richard Ross, Hot Springs, Ark.

[73] Assignee: Roll-A-Bot, Inc., Hot Springs, Ark.

[21] Appl. No.: 339,095

[22] Filed: Apr. 17, 1989

[51] Int. Cl.[5] ..... A47F 7/00

[52] U.S. Cl. ..... 211/59.2; 312/45

[58] Field of Search ..... 211/59.2, 49.1, 59.4; 312/45, 72; 221/242, 281

[56] References Cited

U.S. PATENT DOCUMENTS

| | | | |
|---|---|---|---|
| 2,852,327 | 9/1958 | Mason | 211/59.2 X |
| 2,996,344 | 8/1961 | Garman | 312/45 |
| 3,286,846 | 11/1966 | Brandes | 211/59.2 |
| 3,318,455 | 5/1967 | Takahashi | 312/45 X |
| 3,805,964 | 4/1974 | Titus, Jr. | 211/59.2 |
| 4,763,963 | 8/1988 | Lauffer et al. | 312/45 |

*Primary Examiner*—Sarah A. Lechok

*Attorney, Agent, or Firm*—Stephen D. Carver

[57] ABSTRACT

A compact, gravity fed storage and dispensing rack for beverage containers. The box-like rack comprises a pair of rigid, generally parallel, and spaced-apart side walls terminating in a rear wall. A pair of upper and lower lengthwise inclined shelves extend generally transversely between the opposing sides. The upper shelf is inclined downwardly interiorly from an access end of the rack. The lower shelf is inclined downwardly from the rear wall towards the access end. Containers roll from the upper shelf at the rack access end into the interior of the rack, through a transfer throat, and then down the lower ramp back to the rack access end for access. To encourage reliable bottle transfer, both shelves are edgewise inclined and transfer throat is defined within the frame between the end of the upper shelf and the beginning of the lower shelf. A variable extension tongue is slidably associated with the input shelf. The tongue may be longitudinally varied in position to adjust the effective length of the upper shelf, thus varying the effective size of the transfer throat. The end of the tongue guides the containers into a resilient cushion disposed within the throat which deforms slightly upon impact of the container and springs back to firmly urge the rolling container on its way down the lower shelf toward the access end of the rack.

17 Claims, 2 Drawing Sheets

FIG. 1
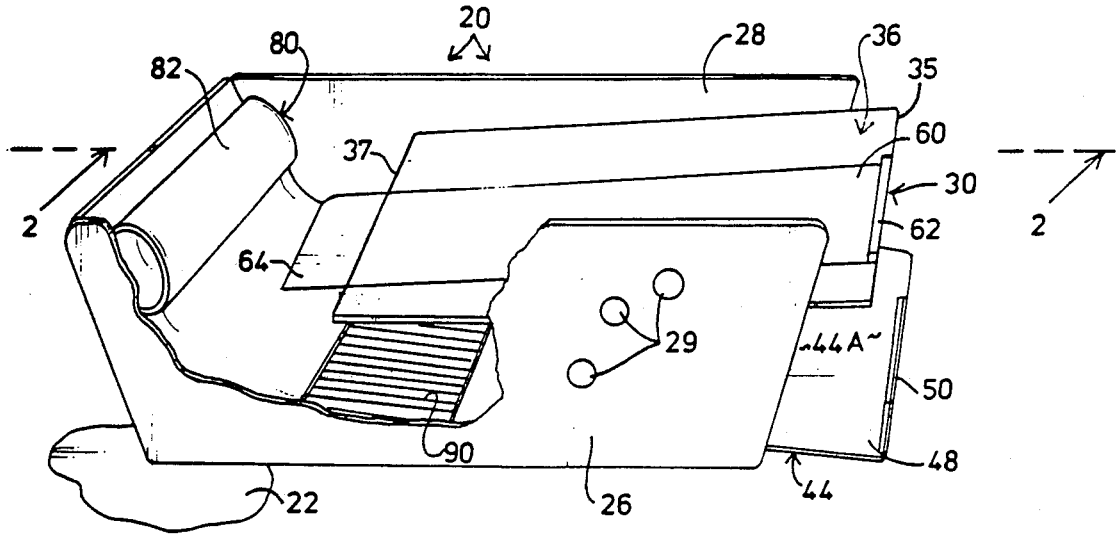
FIG. 2
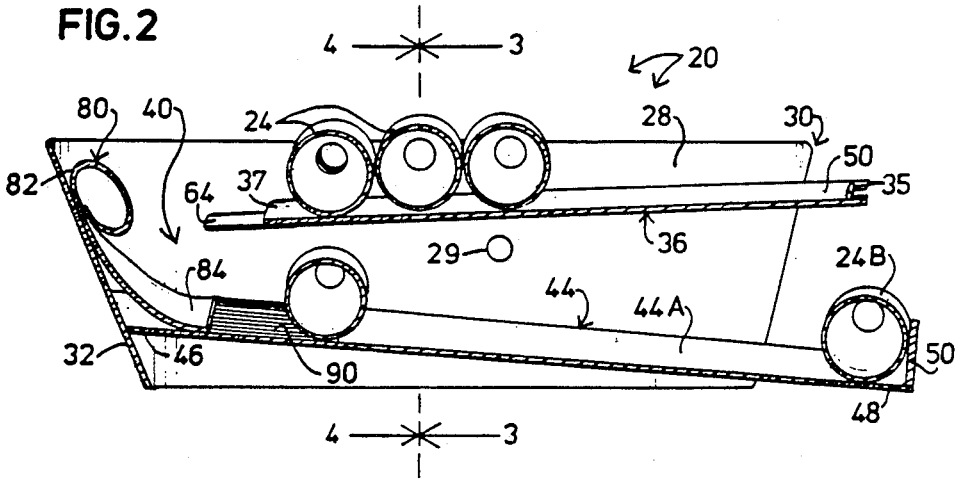
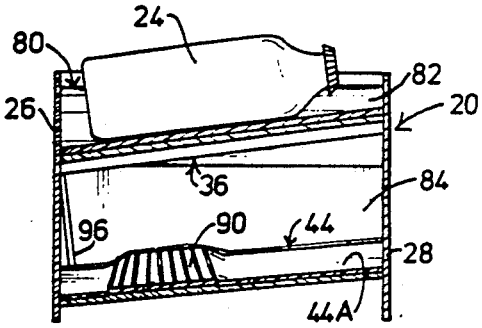
FIG. 3
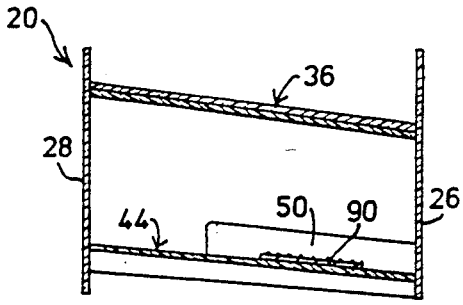
FIG. 4

GRAVITY-OPERATED BOTTLE AND CAN DISPENSING RACK

BACKGROUND OF THE INVENTION

The present invention relates broadly to shelf units for storing and dispensing individual cans or bottles of beverages. More particularly, the present invention comprises an improved gravity-feed rack adapted to be stored within a refrigerator for containing and sequentially dispensing a plurality of beverage containers.

For homeowners it can be difficult and cumbersome to store beer bottles in the refrigerator in neat and orderly rows. Haphazard storage results in inefficient use of the refrigerator's volume. It has also proven desirable and profitable to small store owners to display for sale individual servings of beverages such as carbonated soft drinks, fruit juices, beer, or the like typically contained in aluminum cans or glass bottles in refrigerated compartments for immediate consumption by a purchaser. However, it can difficult to provide sufficient refrigerator shelf space to accommodate an adequate volume of the many brands and varieties of drinks available in today's market. Hence, numerous space-saving storage devices have been proposed in the past for maximizing use of limited refrigerator shelf space.

It has previously been known to provide refrigerator bins or racks for vertically stacking a plurality of beverage cans to be dispensed. A wide variety of gravity-feed can dispensers has been proposed in the prior art. For example, early gravity-feed can dispenser systems are illustrated in U.S. Pat. No. 2,888,145, issued to Knots et al. on May 26, 1959 and, U.S. Pat. No. 3,393,808 issued July 23, 1968 to Chirchill.

Broadly speaking, such prior art dispensers typically comprise an upright housing adapted to support a plurality of vertically stacked, downwardly inclined shelves so arranged that a container inserted in the top-most shelf will be pulled down by gravity along a serpentine path between successive shelves and come to rest in the lowest available space. Most of the prior art dispensers known to me also include some form of front tray or cradle to facilitate display and convenient selection of the beverage can from the front end of the rack.

U.S. Pat. No. 3,306,688, issued Feb. 28, 1967 to Domenico employs a unitary spiraling channel which slows the downward feed of beverage cans. The bin dispenser proposed by Umsted, U.S. Pat. No. 2,195,162 issued Dec. 1, 1959 employs a plurality of inclined rack components adapted to be vertically stacked to form a track for guiding canned beverages downwardly through the dispenser. A drop slot defined in the lowermost end of each rack component guides the beverage can smoothly onto the shelf below. The drop slot maintains the can in horizontal position with both ends roughly parallel to the rack side walls, thus preventing sideways deflection which would result in jamming.

A number of variations and improvements on the basic design of gravity-feed can dispensers has been proposed in the prior art. Deffner et al., U.S. Pat. No. 4,105,126, issued Aug.8, 1978, propose an improved, modular dispensing rack comprising a plurality of identical, interchangeable shelf components. The components may be quickly and conveniently coupled together to create vertical racks of selective desired sizes. The individual shelves are slightly downwardly inclined to assist gravity-feed, and each comprises integral side rails of different heights adapted to accommodate varying sizes of cans without jamming. Eckert, U.S. Pat. No. 4,228,903, issued Oct. 21, 1980 provides similar individual dispensing modules which may be vertically stacked as well as connected side-by-side to increase storage capacity.

However, neither of the last-mentioned systems provides for sequential downward feed of beverage cans from one shelf to another into a final dispensing tray. Thus, each shelf must be separately loaded for dispensing and each will hold only a very limited number of cans at a given time. Of less relevance to the present invention are certain vending machine systems which employ broad principles of gravity-feed technology, such as those disclosed by Gross, U.S. Pat. No. 3,416,706 issued Dec. 17, 1968, and Baxendale, U.S. Pat. No. 3,795,345 issued Mar. 5, 1974.

Use of prior art gravity-feed dispensers known to me has several notable disadvantages. A major disadvantage is that such dispensers are not suited for use with the individual glass bottles popularized by the beverage companies in recent years. When laid horizontally in a typical gravity-feed rack, the bottles do not roll evenly, since the greater volume of beverage is concentrated in the lower portion of the bottle, and since the narrow-diameter neck portion is not restrained by the shelf or guide rail. Hence, the bottle would tend to deflect sideways on the inclined shelf. Additionally, a bottle passing through a drop slot such as in Eckert '903 device would more often than not fall bottom first and land upright rather than horizontally on the shelf below, resulting in undesired jamming. No teaching is found in the prior art for effectively accommodating both glass bottles and cans. Hence it would be desirable to provide a gravity-feed dispenser in which the shelf components may be so positioned to accommodate either canned or bottled beverages.

Inadequate end trays are another disadvantage common in prior art dispensers. In an effort to make the beverages more conveniently accessible to the purchaser, prior art designers have failed to provide adequate means for properly restraining the cans in the display position. Thus cans loaded in the top may fall and push the lowermost cans forward out of the rack, so that they fall out into the display case or onto the floor. This may result in costly loss of product or injury to the perspective purchaser. Thus, it is desired to provide a gravity-feed beverage dispenser which employs a more secure, easily accessible display tray.

A further shortcoming of prior art dispenser racks known to me is inadequate cushioning to prevent damage to the beverage container resulting from impact experienced during feeding. Aluminum cans may be dented and bent; glass containers may be chipped or broken and cause serious injury to the consumer. Moreover, without adequate cushioning or restraint, the impact may unduly agitate the contents, resulting in explosion or inconvenient spraying of the purchaser upon opening. Hence, improved cushioning means for a gravity-feed beverage dispenser would be desirable.

Finally, it will be appreciated that may of the referenced prior art dispensers are not well-suited for use in the home environment, where refrigerator storage space is also limited. Hence, it would be desirable to provide a dispenser which can be readily adapted for home use as well as in the commercial environment.

SUMMARY OF THE INVENTION

The present invention comprises an improved gravity-feed beverage refrigerator storage bin for storing and dispensing canned and bottled beverages. The rack unit comprises a box-like exterior frame comprising a pair of rigid side walls maintained in generally parallel, spaced-apart position by a rear wall. In the best mode, a pair of rigid, generally planar, upper and lower shelves disposed within the rack extend generally transversely between opposing sides of the frame. The ramp-like shelves support the beverage containers.

The upper shelf is lengthwise inclined from the access end downwardly towards the remote end of the shelf. Similarly, the lower shelf is lengthwise inclined downwardly towards the access end. In this fashion beverage containers will roll from the upper shelf of the unit access end into the interior of the rack, and then back to the access end for presentation at the mouth of the lower shelf at the access end. To facilitate reliable bottle transfer, both shelves are edgewise inclined as well. In this fashion a container of nonuniform diameter will tend to be oriented with its longitudinal axis nearly perpendicular to the rack side walls. Stated another way, non-uniform diameter bottles will tend to be maintained flatter. Easier rolling results.

A transfer throat is defined within the frame between the end of the upper shelf and the beginning of the lower shelf. This transfer throat receives a variable extension tongue associated with the input shelf. The tongue may be longitudinally varied in position with respect to the upper shelf to adjust the effective length of the upper shelf, thus varying the effective size of the transfer throat. The end of the tongue guides the containers into a resilient liner or cushion disposed within the throat which deforms slightly upon impact of the container and springs back to urge the rolling container downwardly on the lower track.

Thus it is a broad object of the present invention to provide a storage rack for conveniently displaying and dispensing beverages containers.

Another broad object of the present invention to provide a gravity-feed dispenser rack for facilitating convenient user access to both canned and bottle beverages.

A fundamental object of the present invention is to provide a gravity feed beverage container dispenser rack of the character described which may be adjusted by the user to insure dependable container feed.

Another object of the present invention is to provide an improved gravity-feed dispenser rack having planar shelves inclined lengthwise and inclined edgewise for facilitating proper feeding of beverages.

Yet another object of the present invention is to provide an improved gravity-feed rack for dispensing canned and bottled beverages containers.

Still another object of the present invention is to provide an improved gravity-feed beverage dispenser of the character described which comprises a selectively adjustable tray member for facilitating feeding of glass bottles.

A further object of the present invention is to provide an improved beverage dispenser rack of the nature described which may be readily adapted for use in a home refrigerator unit.

Another object is to provide an improved beverage dispenser rack of the character described which includes means for cushioning beverage containers during feeding to prevent damage and product loss.

Yet another object is to provide an improved gravity-feed beverage dispenser which may be selectively arranged to store and display either canned or bottled beverages.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 1 is a fragmentary, perspective view of a GRAVITY-OPERATED BOTTLE AND CAN DISPENSING RACK, showing the best mode thereof;

FIG. 2 is a fragmentary, longitudinal, sectional view thereof, with portions omitted for clarity;

FIG. 3 is a fragmentary, vertical, sectional view taken generally along line 3—of FIG. 2;

FIG. 4 is a fragmentary, vertical, sectional view taken generally along line 4—4 of FIG. 2, with portions omitted for clarity;

DETAILED DESCRIPTION

Figure 5:
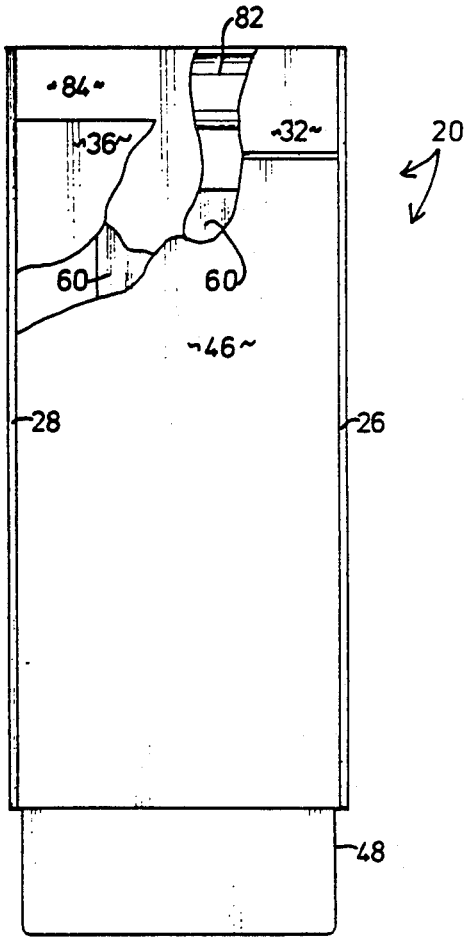
FIG. 5 is a fragmentary bottom plan view thereof, with portions broken away or omitted for clarity.

With initial reference now directed to FIGS. 1 and 2 of the drawings, a gravity operated rack for storing and dispensing beverage containers, preferably bottles, constructed in accordance with the teachings of the present invention has been broadly designated by the reference numeral 20. Rack 20 is ideally placed upon a supporting surface 22 within a conventional refrigerator. In this manner beverage containers 24 may be conveniently stored in the refrigerator, and they may be serially withdrawn from the rack after cooling. Warm beverage containers such as the illustrated bottles are inputted into the access top of the rack, and they roll down the ramps toward a discharge position. Cooled bottles may be withdrawn from the rack at its lower shelf after refrigeration. Each time a bottle is withdrawn, the remaining bottles will roll into position for a subsequent vend.

Rack 20 is of generally rectilinear proportions, and it comprises a flat bottom suitable for typical refrigerator shelves. A rigid frame comprises pair of planar sides 26 and 28 which are spaced apart by a rigid rear wall 32. Sides 26 and 28 are generally parallel with one another, and they extend between an open access end of the rack, which has bene generally designated by the reference numeral 30, and the rear wall 32 forming the back of the frame. Sides 26 and 28 are preferably provided with a plurality of ventilation orifices 29 which facilitate air circulation to promote cooling.

Rack 20 comprises at least two cooperating internal shelves. Both of the shelves are inclined lengthwise, and they are rigidly fastened to and extend generally transversely between frame walls 26 and 28. An upper input shelf 36 has its highest input end 35 disposed at the access end 30 of the rack 20, and as viewed in FIG. 1, it is lengthwise inclined, terminating in a lower end 37 disposed within the interior of the rack 30. As best viewed in FIG. 2, containers 24 placed upon input shelf 36 at access end 30 of the rack will roll forward into the rack interior toward rear wall 32. Bottles rolling off shelf 36 fall into a transfer throat, generally designated by the reference numeral 40, prior to contact with the lower internal shelf 44.

Shelf 44 is spaced-apart from upper input shelf 36 within the rack 20. Preferably the remote input end 46 (FIG. 2) rigidly terminates at wall 32. Its access end 48 includes a stop 50 which will prevent a container 24B from rolling out of the rack. As noted in FIG. 2, the end 46 of rack 44 generally receives containers dropping through throat 40, which containers roll along the lengthwise inclined shelf 44 towards the access end 30 of the rack for withdrawal and subsequent consumption by a consumer.

As indicated above both shelves 36 and 44 are lengthwise inclined to effectuate a rolling transfer of containers through the rack interior. However, with reference to FIGS. 3 and 4, it will also be appreciated that the shelves 36 and 44 are edgewise inclined. Thus it will be noted that the edges of the shelves 36 and 44 which abut the right side wall 28 (FIG. 3) are elevated from the corresponding lower shelf edges attached to frame sidewall 26. As seen in FIGS. 3 and 4 the edgewise angle of incline of both shelves 36 and 44 are substantially the same.

In my experience most can or bottle feeding problems in prior art devices originate at the transfer region where containers drop from one shelf to the lower shelf. Hence in my system I have provided a means whereby throat 40 can be strictly controlled, and both shelves 36 and 44 have been modified to readily accommodate product transfer and conveyance throughout the entire rack.

Figure 6:
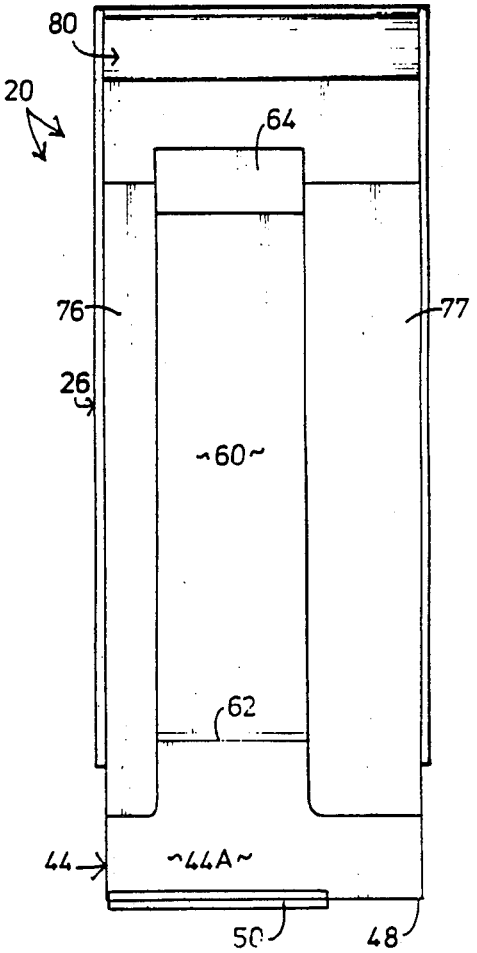
FIG. 6 is a fragmentary top plan view thereof.
Figure 7:
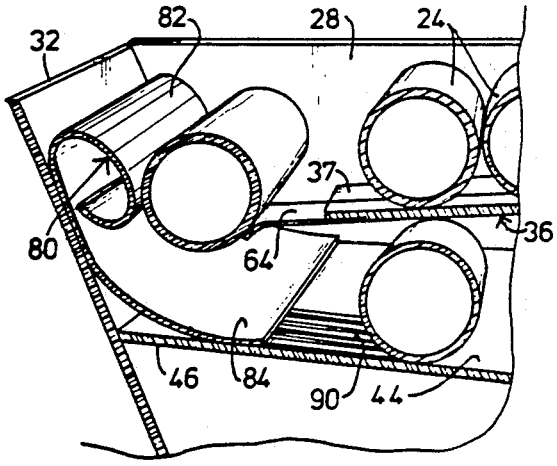
FIG. 7 is an enlarged, fragmentary, oblique view showing the throat between the rack shelves.
Figure 8:
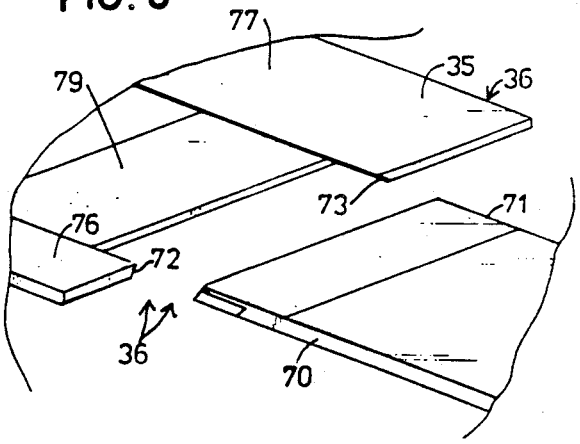
FIG. 8 is an enlarged, fragmentary, exploded view of the longitudinal tongue and track in which it is captivated, associated with the upper shelf.

With additional reference directed now to FIGS. 5 through 8, conveyance control is ideally effectuated with the variable extension tongue, generally designated by the reference numeral 60 which is substantially equal in length to the upper shelf 36, being of a somewhat reduced width. Tongue 60 is axially slidable relative to shelf 36, to which it is received. Moreover, tongue 60 is substantially co-planar with shelf 36, so as not to interfere with the rolling of containers 34.

Tongue 60 comprises an end rail 62 disposed adjacent access end 30 of the rack 20 enabling a user to conveniently grasp the tongue for adjustments. Tongue 60 terminates in a resilient tab 64 projecting toward throat 40. With primary reference directed to FIG. 8, the tongue 60 has a pair of opposite beveled side edges 70, 71 which are captivated between mating internal edges 72, 73 defined in the parallel side portions 76, 77 of the upper shelf 36. The side elements 76, 77 are braced by underlying cross panels 79 over which the tongue 60 will slidably move.

Thus a slidable track is defined between inner edges 72 and 73 and above cross plates 79 in which tongue 60 is slidably constrained. It will thus be apparent that when tongue handle 62 is grasped by a user, he may firmly longitudinally move the tongue 60 inwardly or outwardly of the rack to vary the position of the flexible tab 64. By variably positioning the tab 64 within throat 40, containers of different sizes and weights may be accommodated, since dropping through the throat 40 will be effected in combination with the cushion system 80 to be now described.

Cushion 80 comprises a generally cylindrical portion 82 which extends generally transversely across throat 40 between side walls 26 and 28 above end 46 of lower shelf 44. Alternatively, it may comprise a single layer of resilient material It unwinds into a gradually descending planar terminal portion 84 which contacts the horizontal upper surface 44A of the lower shelf 44. Thus when containers 24 drop through throat 40, they are deflected by tab 64 into contact with cushion 80, and when they roll downwardly they are initially guided upon terminal portion 84.

For bottle control the lower shelf 44 includes a narrow, resilient pad 90 which receives bottles deflected by cushion 80. Pad 90 is spaced apart somewhat from the left side wall 26, and it is of a width substantially less than the width of the shelf 44. Additionally shelf 44 includes a wedge shaped internal shim 96 disposed along wall 26 adjacent pad 90. The bottom of the shim is wider than its top. Shim 96 will thus urge the bottom of a container falling though the throat towards pad 90. Because of the incline, only a small section of the bottom of the container rolling though the throat will be able to frictionally engage the shim 96. In this manner friction will be reduced in the critical transfer throat, to promote reliable transfer of containers between the upper and lower shelves.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A gravity-operated rack for storing and subsequently dispensing individual beverage containers such as bottles and cans, said rack comprising:

a rigid frame having a front, rear, and interior, said frame adapted to be disposed upon a supporting surface, said frame comprising a pair of vertically upright, spaced-apart sides and a rear wall extending between said sides;

an access end defined at the front of said frame, said access end adapted to receive and discharge said containers;

a transfer throat defined in the interior of said frame adjacent said rear wall;

an upper, lengthwise inclined input shelf extending between said sides and comprising an input end disposed at said rack access end and an output end terminating within said rack adjacent said throat;

a lower, lengthwise inclined discharge shelf disposed beneath said input shelf within said frame and extending between said sides, said discharge shelf comprising an input end adjacent said throat and a discharge end disposed at said rack access end; and, a variable extension tongue slidably associated with said input shelf for varying the effective length thereof, said tongue adapted to selectively occlude said transfer throat to control passage of said containers rolling down the input shelf toward said throat.

2. The rack as defined in claim 1 wherein said input shelf and said discharge shelf are edgewise inclined between said frame sides whereby to facilitate reliable dispensing of containers of non-uniform diameter.

3. The rack as defined in claim 2 wherein said throat comprises a resilient cushion disposed upon said rear wall above said lower discharge shelf which is adapted to be impacted by said containers dropping from said input shelf through said throat for deflecting said dropping containers toward said discharge shelf.

4. The rack as defined in claim 3 wherein said lower discharge shelf comprises a resilient pad disposed adjacent said cushion for guiding said containers.

5. The rack as defined in claim 4 wherein said lower discharge shelf comprises a wedge shaped, vertically disposed shim at said insert end adjacent said throat for lowering rolling friction of said containers.

6. The rack as defined in claim 1 wherein said input shelf comprises a central track for slidably receiving said variable extension tongue.

7. The rack as defined in claim 6 wherein said variable extension tongue comprises a rigid, planar plate terminating in a flexible tab disposed within said throat.

8. The rack as defined in claim 7 wherein said flexible tab cooperates with said cushion to facilitate smooth feed of said containers through said throat.

9. The rack as defined in claim 8 wherein said input shelf and said discharge shelf are edgewise inclined between said frame sides.

10. The rack as defined in claim 9 wherein said throat a resilient cushion disposed upon said rear wall above said lower shelf which is adapted to be impacted by said containers dropping from said input shelf through said throat for deflecting said dropping containers toward said discharge shelf.

11. The rack as defined in claim 10 wherein said lower discharge shelf comprises a resilient pad disposed adjacent said cushion for guiding said containers.

12. The rack as defined in claim 11 wherein said lower discharge shelf comprises a wedge shaped, vertically disposed shim at said input end adjacent said throat for lowering rolling friction of said container.

13. A gravity-operated bottle rack for storing and subsequently dispensing individual beverage containers, said rack comprising:

a rigid frame having a front, rear, and interior, said frame adapted to be disposed upon a supporting surface, said frame comprising a pair of rigid, vertically upright, spaced-apart sides and a rigid rear wall extending between said sides;

an access end conveniently disposed at the front of said frame for receiving and discharging said containers;

a transfer throat defined in the interior of said frame adjacent said rear wall, said throat comprising a resilient cushion adapted to be impacted by said containers feeding through said frame;

a pair of cooperating, lengthwise and edgewise inclined shelves rigidly extending between said sides and comprising an upper input shelf for rolling said containers from said access end toward said transfer throat, and a lower discharge shelf for receiving said containers from said transfer throat and rolling them toward said access end; and, a selectively adjustable tongue slidably associated with said input shelf to selectively vary the length of the input shelf to control passage of said containers through said throat, said tongue comprising a rigid, planar plate terminating in a flexible tab.

14. The rack as defined in claim 13 wherein said lower discharge shelf comprises a wedge shaped, vertically disposed shim adjacent said throat for lowering rolling friction of said container.

15. The rack as defined in claim 13 wherein said input, shelf comprises a central track for slidably receiving said selectively adjustable tongue.

16. The rack as defined in claim 15 wherein said flexible tab cooperates with said cushion to facilitate smooth feed of said containers through said throat.

17. A gravity-operated rack for storing and subsequently dispensing bottles and cans, said rack comprising:

a rigid frame having a front, rear, and interior said frame adapted to be disposed upon a supporting surface, said frame comprising a pair of rigid, vertically upright, spaced-apart sides and rigid rear wall means for bracing said frame said rear wall means extending between said sides;

an access end conveniently disposed at the front of said frame for receiving and discharging bottles and cans;

a transfer throat defined in the interior of said frame adjacent said rear wall means;

a lengthwise and edgewise inclined input shelf for rolling said bottles and cans from said access end toward said transfer throat;

a lengthwise and edgewise inclined discharge shelf disposed beneath said input shelf for receiving said bottles and cans from said transfer throat and rolling them toward said rack access end; and, selectively adjustable tongue means slidably associated with said input shelf for selectively varying the length of the input shelf to control passage of said bottles and cans through said throat.

* * * * *